US006935298B2

(12) United States Patent
Ueshima et al.

(10) Patent No.: US 6,935,298 B2
(45) Date of Patent: Aug. 30, 2005

(54) LUBRICATING DEVICE FOR MOTORCYCLE ENGINE

(75) Inventors: Atsushi Ueshima, Akashi (JP); Yoshiharu Matsuda, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/942,380

(22) Filed: Sep. 16, 2004

(65) Prior Publication Data

US 2005/0061288 A1 Mar. 24, 2005

(30) Foreign Application Priority Data

Sep. 19, 2003 (JP) ..... 2003-327999

(51) Int. Cl.[7] ..... F01M 1/00

(52) U.S. Cl. ..... 123/196 R; 123/195 AC; 184/6.5; 180/218

(58) Field of Search ..... 123/196 R, 195 AC; 184/6.5; 180/218

(56) References Cited

U.S. PATENT DOCUMENTS 4,721,077 A * 1/1988 Fukuo et al. ..... 123/195 R
6,227,155 B1 * 5/2001 Tosaka et al. ..... 123/90.34
6,739,291 B2 * 5/2004 Kawakubo et al. ..... 123/41.35
2003/0101960 A1 * 6/2003 Tsuchiya et al. ..... 123/196 R

FOREIGN PATENT DOCUMENTS

JP 2001-227317 8/2001

* cited by examiner

*Primary Examiner*—Weilun Lo

(57) ABSTRACT

There is provided a lubricating device for a motorcycle combustion engine, which allows the motorcycle to exhibit a desired banking angle and also to have a lower center of gravity. The lubricating device is designed to supply a lubricant oil to an in-line multicylinder combustion engine (E) mounted on a motorcycle frame structure (FR) and having a crankcase (CR) and includes a main gallery (21) formed in a lower portion of the crankcase (CR) and journal oiling passages (25) branched off from the main gallery (21) for supplying the lubricant oil towards crank journals (23*b*) of a crankshaft (23) of the engine. The main gallery (21) has opposite end portions (21*a*, 21*a*) inclined to extend outwardly upwardly.

9 Claims, 2 Drawing Sheets

LUBRICATING DEVICE FOR MOTORCYCLE ENGINE

BACKGROUND OF THE INVENTION

1. Field of the Invention

The present invention relates to a lubricating device for a motorcycle combustion engine having a lower center of gravity.

2. Description of the Prior Art

The conventional lubricating device for a multicylinder combustion engine generally employed in motorcycles is of a design in which journal oiling passages for supplying a lubricant oil from a main gallery, formed in a lower portion of the engine casing, towards bearings for a crankshaft are so formed as to branch off from the main gallery. Lubrication for a valve mechanism and a transmission is carried out through oil supply passages that are separate from the journal oiling passages. See, for example, the Japanese Laid-open Patent Publication No. 2001-227317.

However, the prior art lubricating device has a problem. Specifically, since the main gallery is formed to extend straight horizontally in a lower portion of the engine casing in a transverse direction, that is, in a left to right direction of the motorcycle, opposite end portions of the lower portion of the engine casing, which correspond to opposite end portions of the main gallery, extend horizontally in the transverse direction, resulting in an insufficient banking angle being secured. The banking angle represents the angle of tilt of the motorcycle with respect to a road surface during, for example, cornering. Because of this, the prior lubricating device has a difficulty in allowing the position of the motorcycle combustion engine to be lowered in an attempt to lower the center of gravity of the motorcycle as a whole.

SUMMARY OF THE INVENTION

In view of the foregoing, the present invention is intended to provide an improved lubricating device for a motorcycle combustion engine, which allows the motorcycle to exhibit a desired large banking angle and also to have a lower center of gravity.

In order to accomplish the foregoing object of the present invention, a lubricating device for a motorcycle combustion engine in accordance with the present invention for supplying a lubricant oil to an in-line multicylinder combustion engine having a crankcase and mounted on a motorcycle frame structure with cylinders disposed in-line along a transverse direction of the motorcycle frame structure, which includes a main gallery formed in a lower portion or region of the crankcase and journal oiling passages branched off from the main gallery for supplying the lubricant oil towards crank journals of a crankshaft of the engine. The main gallery has opposite end portions inclined to extend outwardly and upwardly.

According to the above structure, since the opposite end portions of the main gallery are so inclined as to extend outwardly and upwardly, the lower portion of the crankcase, in which the main gallery extends, can have its opposite end portions so cut as to follow the shape of the opposite end portions of the main gallery. This feature allows the opposite end portions of the lower region of the crankcase to be positioned above a substantially intermediate portion of the lower region and, therefore, the motorcycle combustion engine as a whole can be arranged at a lower position of the motorcycle frame structure as compared with that in the prior art motorcycle frame structure so that the center of gravity of the motorcycle frame structure can advantageously be lowered, while allowing the motorcycle to exhibit a relatively large desired banking angle.

In a preferred embodiment of the present invention, the crankcase has a lower surface formed with opposite end portions which may be inclined to extend outwardly and upwardly in correspondence with the inclination of the opposite end portions of the main gallery.

In another preferred embodiment of the present invention, the opposite end portions of the main gallery referred to above may be inclined to extend outwardly and upwardly from substantially transverse intermediate positions of left and right crank chambers for two of engine cylinders, which are positioned leftmost and rightmost in the engine.

In a further preferred embodiment of the present invention, crank webs of the crankshaft in two of engine cylinders, which are positioned leftmost and rightmost in the engine, may be cut so as to extend outwardly and upwardly in correspondence with the inclination of the opposite end portions of the main gallery.

In a still further preferred embodiment of the present invention, an imaginary plane containing an axis of the crankshaft and an axis of an input shaft engageable with the crankshaft may lie substantially horizontally, and an axis of an output shaft engageable with the input shaft is positioned above the imaginary plane.

According to the last mentioned feature of the present invention, where such imaginary plane is applied to the motorcycle, the crankshaft, the input shaft and the output shaft are so positioned as to represent a generally triangular geometry with the crankshaft and the input shaft lowered in position and, therefore, the center of gravity of the motorcycle combustion engine can advantageously be lowered to result in lowering of the center of gravity of the motorcycle frame structure.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
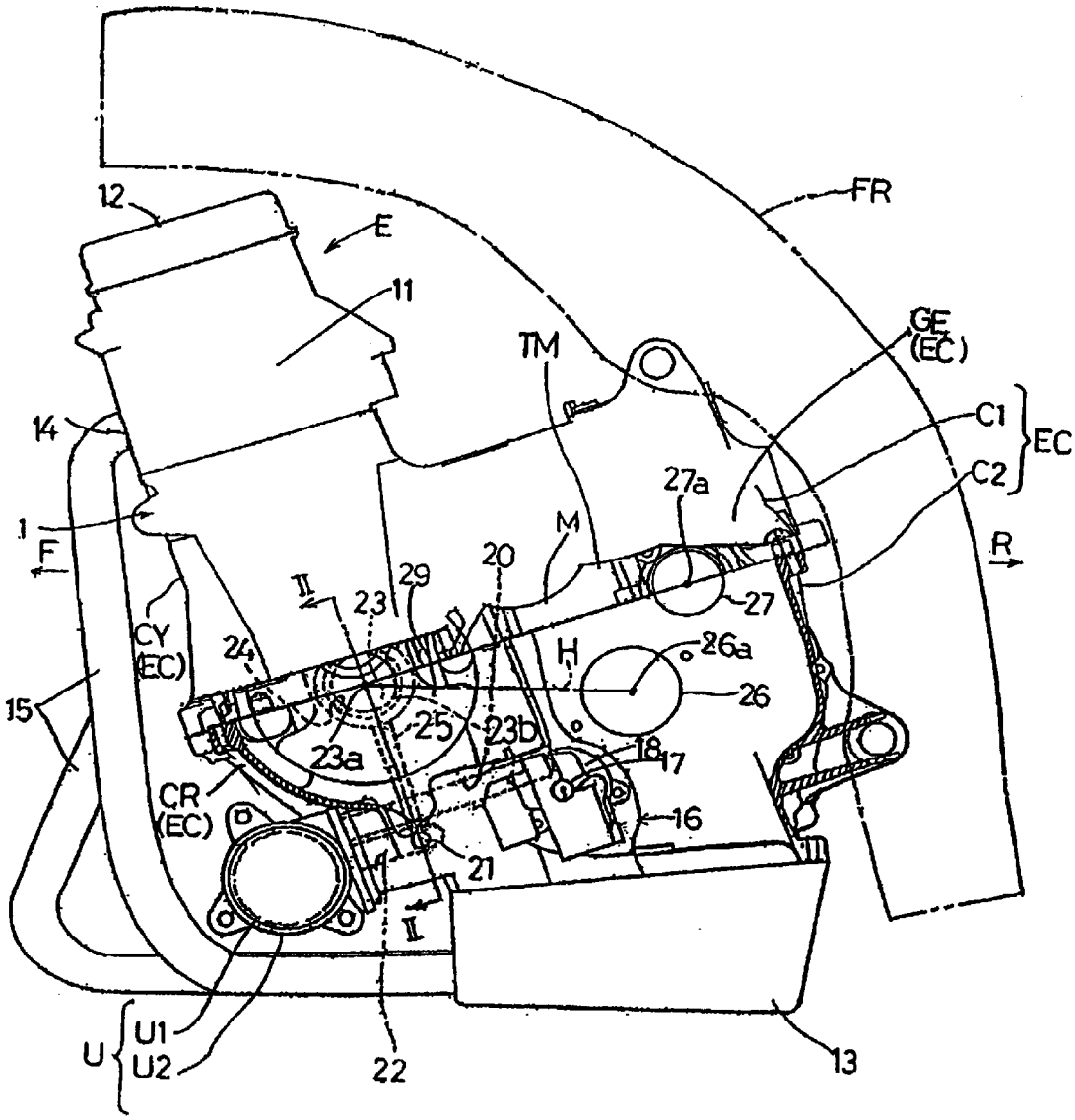
FIG. 1 is a side view of a motorcycle combustion engine employing a lubricating device according to a preferred embodiment of the present invention, with a portion thereof cut out.

Hereinafter, a preferred embodiment of the present invention will be described in detail with reference to the accompanying drawings. FIG. 1 shows a side view of a motorcycle in-line multi-cylinder internal combustion engine E employing a lubricating device according to the preferred embodiment of the present invention with a portion thereof cut out.

The motorcycle combustion engine E is an in-line four-cylinder, four cycle combustion engine and is mounted on a front lower portion of a motorcycle frame structure FR shown by a phantom line, with the four cylinders disposed in-line along a transverse direction of a motorcycle, or a direction transverse to a longitudinal sense of the motorcycle frame structure FR. This motorcycle combustion engine E includes an engine body 1, which in turn includes an engine casing EC made up of a crankcase CR, an engine cylinder block CY and a gear case GE. The crankcase and engine cylinder block CY are positioned on a front side F of the engine body 1 while the gear case GE is positioned on a rear side R of the engine body 1. The engine casing EC is of a two-piece metal cast including an upper casing component C1 and a lower casing component C2. The upper casing component C1 is formed integrally with the engine cylinder block CY and an upper half portion of the gear case GE while the lower casing component C2 is formed integrally with the crankcase CR and a lower half portion of the gear case GE. A cylinder head 11 is fixedly mounted on a top surface of the engine cylinder block CY in the upper casing component C1, and a cylinder head cover 12 having a valve chamber defined therein is in turn mounted fixedly on a top surface of the cylinder head 11.

A crankshaft 23 is supported within the crankcase CR by bearings 24 and has a plurality of crank webs 29 formed thereon as shown by a phantom line. This crankshaft 23 extends substantially in the transverse direction and, hence, the four cylinders of the combustion engine E are arranged in line with each other in a direction substantially transverse to the longitudinal sense of the motorcycle frame structure FR. An oil reservoir or pan 13 is fixedly secured to a lower surface of the lower casing component C2. As indicated above, the engine casing EC, the cylinder head 11, the cylinder head cover 12 and the oil pan 13 altogether constitute the engine body 1.

Referring still to FIG. 1, the cylinder head 11 has four exhaust ports 14 defined therein and fluid-connected with respective exhaust pipes 15. A pump unit 16 is mounted on the lower casing component C2 and positioned above the oil pan 13. This pump unit 16 includes a water supply pump (not shown) and an oil supply pump 18 mounted on one end of a pump shaft 17 that extends parallel to the crankshaft 23, the opposite end of the pump shaft 17 being drivingly coupled with the crankshaft 23 by means of a gear unit (not shown). An oil filter/cooler unit U made up of an oil filter U1 and an oil cooler U2 is mounted on a front surface of the lower casing component C2.

The oil supply pump 18 and the oil filter/cooler unit U are fluid-connected with each other by means of a first oil supply passage 20 defined in the lower casing component C2 and, on the other hand, the oil filter/cooler unit U is fluid-connected with a main gallery 21, which is so defined in a lower portion of the lower casing component C2 or a lower region of the crankcase CR as to extend in a direction of an axis of the crankshaft 23, by means of a second oil supply passage 22. The main gallery 21 is in turn fluid-connected with journal oiling passage 25 that are branched off from the main gallery 21 for supplying a lubricant oil to crank journals 23*b* of the crankshaft 23 through the bearings 24.

The gear case GE accommodates a transmission TM for transmitting a rotatory drive of the crankshaft 23 to a rear wheel (not shown) through a suitable drive transmitting member (not shown) such as a chain or a shaft. This transmission TM includes an input shaft 26, engageable with the crankshaft 23 by means of a clutch (not shown), and an output shaft 27 drivingly engageable with the input shaft 26 through a transmission gear train (not shown) for transmitting the rotatory drive to the drive transmitting member.

It is to be noted that, in the illustrated embodiment, an imaginary plane H containing an axis 23*a* of the crankshaft 23 and an axis 26*a* of the input shaft 26 lies substantially horizontally, while an axis 27*a* of the output shaft 27 is positioned at a level above the imaginary plane H. In other words, the three shafts including the input shaft 26, the output shaft 27 and the crankshaft 23 are so arranged as to represent a generally triangular geometry, in which the imaginary plane M containing the respective axes 23*a* and 27*a* of the crankshaft 23 and the output shaft 27 is inclined forwardly downwardly with respect to the direction of forward run of the motorcycle, with the axis 26*a* of the input shaft 26 positioned below the inclined imaginary plane M. With the triangular geometry, the crankshaft 23 and the input shaft 26 are disposed at a lower level. The inclined imaginary plane M coincides with an interface at which the upper casing component C1 and the lower casing component C2 of the engine casing EC are jointed together.

Figure 2:
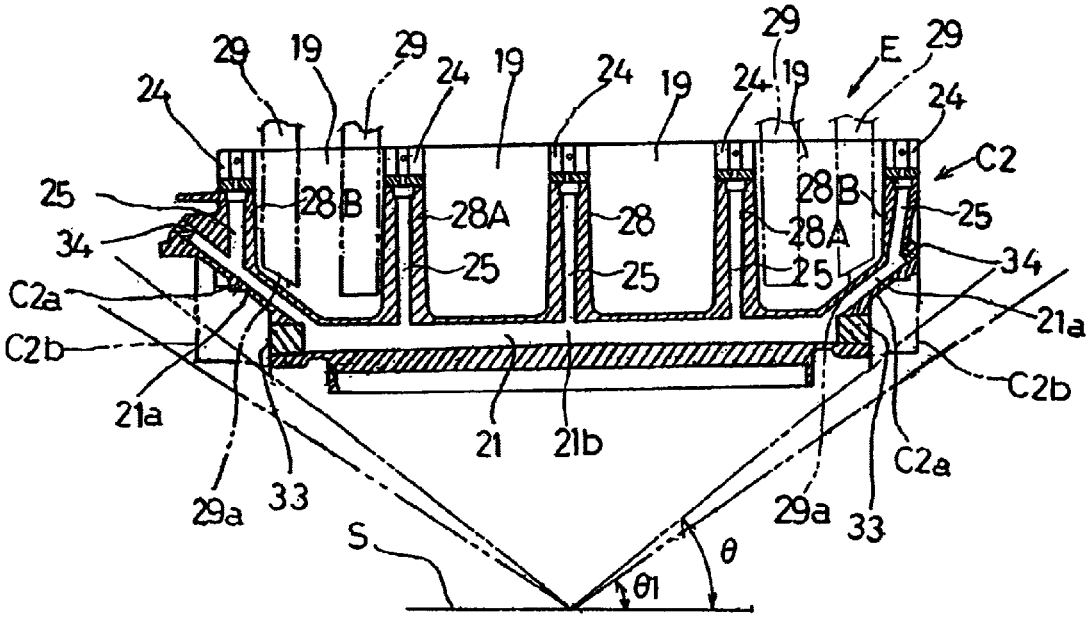
FIG. 2 is a cross-sectional view taken along the line II—II in FIG. 1, showing a plurality of crank webs (shown by a phantom line) of a crankshaft with other component parts of the crankshaft omitted.

Referring now to FIG. 2 showing a cross-sectional representation taken along the line II—II in FIG. 1, there is shown an arrangement of the main gallery 21 relative to the journal oiling passages 25. As shown therein, the main gallery 21 is of a design in which a major portion thereof including an intermediate portion 21*b* is laid substantially horizontally in the transverse direction, that is, in a left to right direction of the motorcycle frame structure FR, while left and right end portions 21*a* and 21*a* of the main gallery 21 are inclined so as to extend outwardly upwardly from substantially intermediate positions of left and right crank chambers 19 and 19 with respect to the transverse direction, respectively. The journal oiling passages 25 branched off from the main gallery 21 are formed in the lower casing component C2, particularly in partition walls 28A and opposite end walls 28B partitioning into the crank chambers, so that a lubricant oil can be supplied from each of the journal oiling passages 25 to the associated crank bearing 24.

Since the intermediate portion 21*b* of the main gallery 21 is laid horizontally with the left and right end portions 21*a* and 21*a* inclined outwardly and upwardly, opposite left and right end portions C2*a* and C2*a* of the lower surface of the lower casing component C2 are cut so as to incline outwardly and upwardly along the left and right end portions 21*a* and 21*a* of the main gallery 21. Accordingly, the two journal oiling passages 25 positioned respectively at the opposite end portions of the lower casing component C2 are shorter than the three remaining journal oiling passages 25 positioned at the major portion of the main gallery 21 and, at the same time, the opposite end walls 28B have a length, as measured in a direction up and down, which is smaller than that of the partition walls 28A positioned between the opposite end walls 28B. In correspondence with the above design of the main gallery 21, respective tips 29*a* of the crank webs 29 associated with the leftmost and rightmost engine cylinders are cut so as to incline outwardly and upwardly as clearly shown in FIG. 2. The intermediate portion 21*b* and the left and right end portions 21*a* and 21*a* of the main gallery 21 are formed by any known machining technique with their openings closed by respective plugs 33 and 34.

With the lubricating device having the main gallery 21 so constructed as hereinabove described, a lubricant oil contained in the oil pan 13 shown in FIG. 1 is pumped by the oil supply pump 18 to flow through the first supply passage 20 towards the oil filter/cooler unit U. After the lubricant oil so supplied to the oil filter/cooler unit U has been filtered therethrough, the lubricant oil is subsequently introduced into the main gallery 21 by way of the second supply passage 22 and is in turn introduced from the main gallery 21 into the journal oiling passages 25. The lubricant oil within the journal oiling passages 25 is then supplied to the bearings 24 for the crankshaft 23 to thereby lubricant the crank journals 23*b* of the crankshaft 23.

As hereinbefore described, the main gallery 21 is of a design in which the left and right end portions 21*a* and 21*a* thereof are so inclined as to extend outwardly upwardly from substantially intermediate positions of the leftmost and rightmost crank chambers 19 and 19 and, in correspondence with the design of the main gallery 21, the left and right end portions C2*a* and C2*a* of the lower surface of the lower casing component C2 are so shaped as to incline outwardly upwardly. Accordingly, acute angled portions C2*b* and C2*b*, shown by the phantom lines in FIG. 2, which have hitherto been found in opposite left and right end portions of a lower casing component of an engine casing having the conventional lubricating device of a type utilizing a main gallery having no inclined end portions, are eliminated effectively in the present invention. As a result, the motorcycle banking angle θ, which represents the angle of tilt of the motorcycle with respect to a road surface S during, for example, cornering, can be larger than the banking angle θ1 hitherto afforded. Hence, where a desired banking angle is θ1, the motorcycle combustion engine E can advantageously be mounted on the motorcycle frame structure FR at a position lower than the conventional engine to thereby allow the motorcycle combustion engine E to have a lower center of gravity.

Also, since the three shafts including the crankshaft 23, the input shaft 26 and the output shaft 27 are so arranged as to represent the generally triangular geometry as hereinabove described, the front-to-rear length or the longitudinal dimension of the motorcycle combustion engine E can advantageously be reduced, as compared with the conventional motorcycle engine of the arrangement in which those three shafts are laid in line with each other in a direction conforming to the longitudinal sense of the motorcycle combustion engine, and, accordingly, the motorcycle combustion engine E can be manufactured compact in size.

Furthermore, positioning the crankshaft 23 and the input shaft 26 below the output shaft 27 as hereinbefore described allows the motorcycle combustion engine E to have a lower center of gravity, resulting in further lowering the center of gravity of the motorcycle frame structure FR as a whole.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A lubricating device for a motorcycle combustion engine for supplying a lubricant oil to an in-line multicylinder combustion engine having a crankcase and mounted on a motorcycle frame structure with a plurality of cylinders disposed in-line along a transverse direction of the motorcycle frame structure, the lubricating device comprising:

a main gallery formed in a lower portion of the crankcase; and a plurality of journal oiling passages branched off from the main gallery for supplying the lubricant oil towards crank journals of a crankshaft of the engine;

said main gallery having opposite end portions inclined to extend outwardly and upwardly.

2. The lubricating device as claimed in claim 1, wherein the crankcase has a lower surface formed with opposite end portions which are inclined to extend outwardly and upwardly in correspondence with the inclination of the opposite end portions of the main gallery.

3. The lubricating device as claimed in claim 1, wherein the opposite end portions of the main gallery are inclined to extend outwardly and upwardly from substantially transverse intermediate positions of left and right crank chambers for two of the plurality of engine cylinders, which are positioned leftmost and rightmost in the engine.

4. The lubricating device as claimed in claim 1, wherein crank webs of the crankshaft in two of the plurality of engine cylinders, which are positioned leftmost and rightmost in the engine, are cut so as to extend outwardly and upwardly in correspondence with the inclination of the opposite end portions of the main gallery.

5. The lubricating device as claimed in claim 1, wherein an imaginary plane containing an axis of the crankshaft and an axis of an input shaft engageable with the crankshaft lies substantially horizontally, and wherein an axis of an output shaft engageable with the input shaft is positioned above the imaginary plane.

6. A motorcycle driven by an in-line multicylinder combustion engine having a crankcase and supported by a motorcycle frame structure, the improvement comprising:

the combustion engine extends in a traverse direction to a longitudinal direction of the motorcycle, the lower side exterior portions are slanted inward to enable a larger banking angle in positioning the motorcycle for turns and a lower relative mounting of the combustion engine to the frame structure to provide an overall lower center of gravity;

a main gallery formed in a lower portion of the crankcase; and a plurality of journal oiling passages branched off from the main gallery for supplying lubricant oil towards crank journals of a crankshaft of the combustion engine, said main gallery having opposite end portions and oil passages inclined to extend outwardly and upwardly.

7. The motorcycle of claim 6, wherein cylinder partition walls extend upward from the main gallery, the cylinder partition walls include oil passageways.

8. The motorcycle of claim 7, further including a crankshaft mounted in the combustion engine having a plurality of crank webs, and the crank webs positioned adjacent the lower side exterior portions have a complimentary lower slant shape.

9. The motorcycle of claim 8 wherein an imaginary plane containing an axis of the crankshaft and an axis of an input shaft engageable with the crankshaft lies substantially horizontally, and wherein an axis of an output shaft engageable with the input shaft is positioned above the imaginary plane.

* * * * *